United States Patent [19]

Hara et al.

[11] Patent Number: 4,586,838

[45] Date of Patent: May 6, 1986

[54] COMPACT BATTERY OPERATED PRINTER

[75] Inventors: Kenji Hara, Kitamoto; Yukihiro Nagahori, Kitaadachi; Tsugio Watanabe, Kumagaya; Akio Itoh, Kounosu; Hikoshi Izumi, Hanyu, all of Japan

[73] Assignee: Jeco Co., Ltd., Kanagawa, Japan

[21] Appl. No.: 716,060

[22] Filed: Mar. 26, 1985

[30] Foreign Application Priority Data

Jun. 5, 1984 [JP] Japan ..... 59-83941[U]

[51] Int. Cl.[4] ..... B41J 25/28; B41J 3/36; B41J 29/02

[52] U.S. Cl. ..... 400/320; 400/88; 400/693

[58] Field of Search ..... 400/120, 693, 88, 691, 400/320

[56] References Cited

U.S. PATENT DOCUMENTS

| | | | |
|---|---|---|---|
| 4,379,646 | 4/1983 | Maeda | 400/120 X |
| 4,401,391 | 8/1983 | Kawai et al. | 400/120 |
| 4,500,217 | 2/1985 | Swindler | 400/693 X |

*Primary Examiner*—Clifford D. Crowder

*Attorney, Agent, or Firm*—Townsend and Townsend

[57] ABSTRACT

A handy type printer with dry cells incorporated therein in which an arrangement consisting of dry cells and a paper feed motor aligned, a screw shaft for sliding a head therealong and a head-driving motor are disposed in the order named in parallel with each other; the ends of a platen and the head-driving screw shaft are supported by first and second shaft bearing members, respectively; and a plurality of reduction gears are rotatably mounted on the first shaft bearing member so as to transmit the torques of the paper feed motor and the head-driving motor to the platen and the head-driving screw shaft, respectively.

6 Claims, 2 Drawing Figures

COMPACT BATTERY OPERATED PRINTER

BACKGROUND OF THE INVENTION

The present invention relates to a handy type printer and more particularly a handy type printer with dry cells incorporated therein.

In the printer of the type described, a plurality of, for example, C-size dry cells having a high current capacity and a large outer diameter must be used to drive a paper feed motor and a head-driving motor obtaining their maximum torques. These dry cells occupy a considerably large space in a printer as a whole. Furthermore, the layout of a platen, a paper feed motor, a head driving mechanism and a dry cell storage chamber has not been well balanced in the conventional handy type printers so that many dead spaces are left unused. As a result, the conventional handy type printers are large in size and heavy in weight.

Furthermore, in the conventional handy type printers, a head driving mechanism is generally connected to the shaft of a head-driving motor directly without the use of gears or through one reduction mechanism. This arrangement is based on the condition that high-output motors can be used. As a result, the above-described dead space problem further becomes difficult to solve.

Moreover, in general, a wire or belt is used in a head driving mechanism, but the usage of a wire or belt is not preferable because a high technique as well as a long time are needed to adjust the tension of the wire or belt in the assembly.

SUMMARY OF THE INVENTION

In view of the above, the primary object of the present invention is to provide a handy type printer with dry cells incorporated therein which is so designed and constructed that the layout of the whole structure is well balanced and consequently the handy type printer can be made compact in size and light in weight.

Another object of the present invention is to provide a handy type printer whose assembly can be much simplified.

To attain these and other objects, the present invention provides a handy type printer comprising an arrangement consisting of a dry cell chamber and a paper feed motor which are aligned, a platen disposed adjacent to and in parallel with the series body, a head-driving screw shaft disposed adjacent to and in parallel with the platen on the opposite side of the arrangement, a head carried by the screw shaft, a head-driving motor, first and second shaft bearing members disposed at both ends, respectively, of the platen and the screw shaft so as to support them and a plurality of reduction gears rotatably mounted on the first shaft bearing member so as to transmit the torques of the paper feed motor and the head-driving motor to the platen and the screw shaft, respectively.

DESCRIPTION OF THE PREFERRED EMBODIMENT

Figure 1:
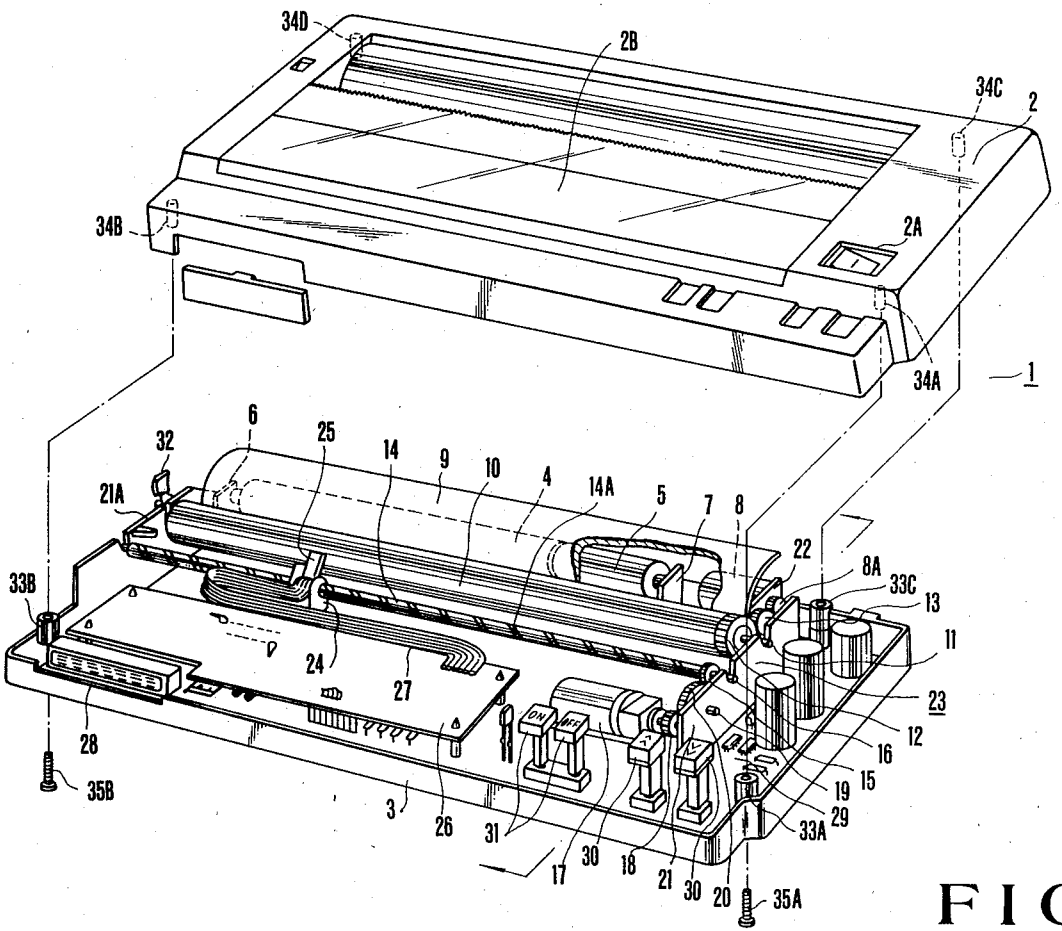
FIG. 1 is an exploded perspective view, partly broken away, of a preferred embodiment of a handy type printer in accordance with the present invention.

A preferred embodiment of the present invention will be described in detail with reference to the accompanying drawings. Referring first to FIG. 1, a handy type printer 1 (to be referred to as a printer hereinafter) comprises a cover 2 with a power switch 2A and a bail cover 2B and a case 3 in which various component parts are arranged.

The case 3 has a battery cell chamber 4 with a positive terminal 6 and a negative terminal 7.

A plurality of dry cells 5 (C-size) are inserted into the dry cell chamber 4, connected in series and securely held in position between the positive and negative terminals 6 and 7 in such a way that the dry cells at the ends of the series-connected dry cells 5 are pressed against the positive and negative terminals 6 and 7, respectively.

A paper feed motor 8 with a motor gear 8A is disposed in series with the dry cell chamber 4 or in line with the dry cell chamber 4.

A protective cover 9 covers the dry cell chamber 4 and the paper feed motor 8.

A platen 10 is rotatably disposed adjacent to and in parallel with the dry cell chamber 4 and the paper feed motor 8 and a gear 12 with a shaft 11 is carried by one end of the platen 10. The motor gear 8A of the paper feed motor 8 is in mesh with an intermediate gear 13 which in turn is in mesh with the gear 12 so that when the paper feed motor 8 is driven, the platen 10 is rotated.

Figure 2:
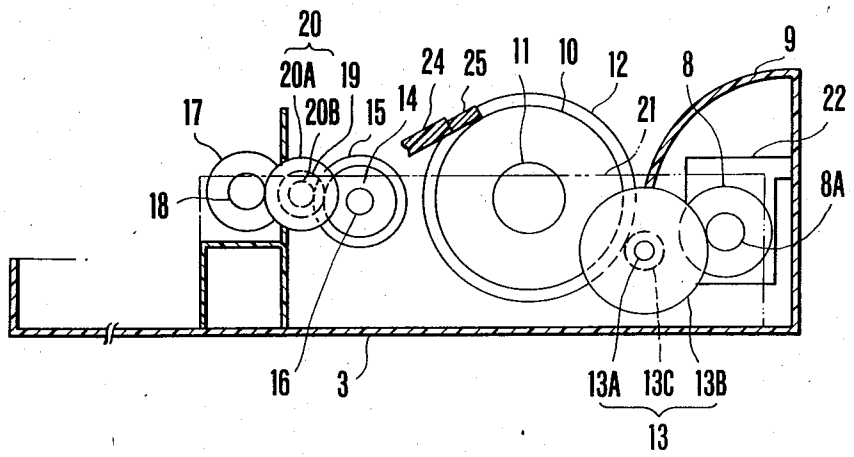
FIG. 2 is a schematic view showing a gear block thereof.

FIG. 2 shows the relationships among these gears. That is, a large gear 13B and a small gear 13C are integrally carried by a shaft 13A of the intermediate gear 13 and the large gear 13B is in mesh with the motor gear 8A while the small gear 13C is in mesh with the gear 12.

A head-driving screw shaft 14 has a screw groove 14A formed in the outer cylindrical surface thereof and is disposed in parallel with, the platen 10.

A gear 15 is integrally carried by a shaft 16 extended from one end of the head-driving screw shaft 14 and is in mesh with an intermediate gear 20 with a shaft 19. The intermediate gear 20 is in mesh with a motor gear 18 of a head-driving motor 17 so that when the motor 17 is driven, the head-driving screw shaft 14 is rotated. As shown in FIG. 2, the intermediate gear 20 comprises a large gear 20A and a small gear 20B which is integral and coaxial with the large gear 20A. The large gear 20A is in mesh with the motor gear 18 while the small gear 20B is in mesh with the gear 15.

A shaft bearing member 21 is disposed in the case 3 and supports the shaft 11 extended from one end of the platen 10, the shaft 16 of the head-driving screw shaft 14 and the shaft 19 of the intermediate gear 20.

A supporting plate 22 supports the motor gear 8A of the paper feed motor 8 and the shaft 13A of the intermediate gear 13.

Therefore, the shaft bearing member 21, the supporting plate 22, the gears 12 and 15, the intermediate gears 13 and 20 and the motor gears 8A and 18 constitute a gear block 23. However, as shown in FIG. 2, the shaft 13A of the intermediate gear 13 may be supported by the shaft bearing member 21. The shaft bearing member 21 and the supporting plate 22 may be made into one piece.

The other ends of the platen 10 and the head-driving screw shaft 14 remote from the gear block 23 are rotatably supported by a shaft bearing plate 21A formed integral with the case 3.

A head driver 24 slides along the head-driving screw shaft 14 when the screw shaft 14 with the screw groove 14A is rotated and carries a head 25 which is made into contact with the cylindrical surface of the platen 10. The head 25 is a thermal head.

A printed circuit board 26 with electronic circuits is electrically connected to the head driver 24 through flexible lead wires 27.

Reference numeral 28 designates a cable connection header.

A circuit component part 29 is directly mounted on the case 3. Paper feed switches 30 are used to shift a sheet of paper in the directions indicated by the arrows marked on the buttons. 31 is a line switch and when an ON button or key is depressed, the printer 1 can receive data from a host computer. When the line switch 31 is turned OFF, it becomes possible to feed a sheet of paper. When a paper release button or knob 32 is depressed, it becomes possible to freely move a sheet of paper.

Various methods for mounting the paper feed motor 8 and the head-driving motor 17 may be considered. For instance, the paper feed motor 8 may be securely mounted on a member made integral with the bottom or side wall of the case 3 or with the supporting plate 22. In like manner, the head-driving motor 17 may be securely mounted on a member made integral with the shaft supporting member 21.

In order to attach the cover 2 to the case 3 in which are disposed the above-described component parts, cylinders 33A, 33B, 33C and 33D (not shown) each having a through hole are extended through the bottom of the case 3 and securely attached thereto while cylinders 34A, 34B, 34C and 34D each having an internally threaded screw are securely attached to the inside surface of the cover 2. When the cover 2 is correctly placed on the case 3, the axes of th lower cylinders 33A, 33B, 33C and 33D are aligned with those of the upper cylinders 34A, 34B, 34C and 34D, respectively. Thereafter, screws 35A, 35B, 35C and 35D (35C and 35D are not shown) are inserted into the lower cylinders 33A, 33B, 33C and 33D, respectively, and tightened so that the lower and upper cylinders 33A-33D and 34A-34D are securely interconnected by means of the screws 35A-35D and consequently the cover 2 is securely attached to the case 3.

Next the mode of operation of the printer will be described.

A cable connector (not shown) is attached to the cable connection header 28 and then the power switch 2A is turned ON. The line switch 31 is turned OFF and the paper feed button or key 32 is depressed to determine the direction in which a sheet of paper is fed.

Then the platen 10 is rotated by the paper feed motor 8 in the direction indicated by the arrow marked on the paper feed button or key.

When the line switch button or key 31 is turned ON, the printer 1 is ready to receive data from a host computer. When the printer 1 receives control codes and data, the head-driving motor 17 is energized to rotate the head-driving screw shaft 14.

As a result, the head driver 24 is caused to slide along the head-driving screw shaft 14 in a predetermined direction and in response to the output signals from the electronic circuits on the printed circuit board 26, the head 25 prints a sheet of paper wrapped on the platen 10.

The present invention has the above-described construction and mode of operation. Especially, the dry cell chamber and the paper feed motor are aligned, the platen and the head-driving screw shaft are disposed in parallel with each other; and the gear block 23 is disposed laterally thereof. As a result, the whole printer has no dead space at all and therefore can be made compact in size and light in weight. Furthermore, a layout balance can be improved.

Moreover, according to the present invention, no chain or belt is used and the component parts are drivingly interconnected with each other by means of gears. As a result, no tension adjustment is needed in the assembly so that the printers in accordance with the present invention can be manufactured in a simple and efficient manner.

What is claimed is:

1. A handy type printer comprising: a housing; a dry cell chamber disposed along one longitudinal wall of said housing for accommodating a plurality of cascade-connected dry cells, the width of said chamber being slightly larger than the diameter of said dry cells;

rotatable cylindrical platen means disposed adjacent to and in parallel with said dry cell chamber for line feeding paper thru said printer;

paper feed motor means disposed at one end portion of said dry cell chamber coaxially with said plurality of cascade connected dry cells for rotating said platen means;

a head-driving screw shaft disposed adjacent to and in parallel with said platen;

a head carried by said head-driving screw shaft;

head-driving motor means disposed adjacent to and in parallel with one end portion of said head-driving screw shaft for rotating said head-driving screw shaft;

first and second shaft bearing members disposed at both ends, respectively, of said platen means and said head-driving screw shaft so as to support them; and a plurality of reduction gears rotatably mounted on said first shaft bearing member to transmit the torque of said paper feed motor means to said platen means and to transmit the torque of said head-driving motor means to said head-driving screw shaft.

2. A handy type printer as set forth in claim 1 wherein said first and second shaft bearing members are upright members formed integral with said housing.

3. A handy type printer as set forth in claim 1 wherein a partition wall is disposed between said dry cell chamber and said platen means, said partition wall having an arcuate shape so as to cover the dry cell chamber and said paper feed motor means, thereby forming a paper outlet.

4. A handy type printer as set forth in claim 1 wherein said head-driving screw shaft has a unidirectional groove thereon.

5. A handy type printer as set forth in claim 1 further including a printed circuit board having a control circuit for controlling driving timing of said platen means and said head-driving screw shaft.

6. A handy type printer as set forth in claim 1 wherein the diameter of said paper feed motor means is no greater than the diameter of each of said plurality of dry cells.

* * * * *